United States Patent [19]

Sneider

[11] Patent Number: 4,485,492

[45] Date of Patent: Dec. 4, 1984

[54] GARMENT SHIELD WITH REMOVABLE OUTER PORTIONS

[76] Inventor: Vincent R. Sneider, 3422 Hallcrest Dr., Hampton Hall, Atlanta, Ga. 30319

[21] Appl. No.: 545,637

[22] Filed: Oct. 26, 1983

[51] Int. Cl.[3] ..... A41D 27/12

[52] U.S. Cl. ..... 2/56; 2/53

[58] Field of Search ..... 2/53-58

[56] References Cited

U.S. PATENT DOCUMENTS 726,357 4/1903 Schultz ..... 2/53

2,269,365 1/1942 Fowler ..... 2/53

*Primary Examiner*—Doris L. Troutman

*Attorney, Agent, or Firm*—Ralph R. Roberts

[57] ABSTRACT

This invention discloses a garment shield whose outer contour is convex and arcuate with the shield adapted for underarm protection of a garment. The shield is made to fold along a central portion and a heat seal retains the initial outer periphery. At least one additional heat seal is made in the shield and at an outer edge of this additional heat seal there is a line of perforations enabling that portion of the shield exterior of the perforations to be removed and discarded. The additional heat seal prevents exposure of the fill at the edge of the line of perforations. The perforations may be in more than one line and slots or small apertures may be made at the line of perforations.

10 Claims, 5 Drawing Figures

GARMENT SHIELD WITH REMOVABLE OUTER PORTIONS

BACKGROUND OF THE INVENTION

1. Field of the Invention

The field of art as established in and by the U.S. Patent and Trademark Office is believed to be found in the General class of "Apparel" and in the subclasses of armpit shields and those having attaching means and to the methods of making.

2. Description of the Prior Art

A pre-Ex search was made of the art in which this invention is believed to be found. The art had many armpit shields but as far as is known shields with adhesive means for securing and having means for easily changing the size to a smaller outer configuration was not found. The following U.S. Patents were noted: U.S. Pat. No. 726,357 to SCHULTZ as issued Apr. 28, 1903; U.S. Pat. No. 2,434,830 to BILLINS et al. as issued Jan. 20, 1948; U.S. Pat. No. 2,654,888 to BRIGHTMAN as issued Oct. 13, 1953; U.S. Pat. No. 2,669,720 to VANDERKERCK as issued Feb. 23, 1954; U.S. Pat. No. 2,747,193 to PULSIFIER as issued May 29, 1956; U.S. Pat. No. 3,019,443 to ROSE as issued Feb. 6, 1962; U.S. Pat. No. 3,259,911 to TYRRELL, Jr. as issued July 12, 1966; U.S. Pat. No. 3,346,878 to MORRIS as issued Oct. 17, 1967; U.S. Pat. No. 3,145,391 to TYRRELL, Jr. as issued Aug. 25, 1964; U.S. Pat. No. 3,588,916 to GLATT as issued June 29, 1971; U.S. Pat. No. 3,619,816 to COWEN as issued Nov. 16, 1971; and foreign patents which include Canadian Pat. No. 463,804 to TYRRELL, Jr. as issued Mar. 21, 1950; German Pat. No. 417,500 to LICKOWSKI as issued Aug. 14, 1925, and U.S. Pat. No. 2,841,365 to HABERMANN as issued Apr. 3, 1980.

Disposable garment shields are well known and are used particularly for the protection of clothing of people who are subject to perspiration such as entertainers who perform under flood lights and in high heat conditions. Garment shields as in the above mentioned patents conventionally have an impervious film strip or backing which prevents the penetration of perspiration or moisture through the shield. These shields are conventionally removably attached by adhesive which may be applied as one or plural strips to the protective impervious film. Garment shields are conventionally crescent shaped and tapered to conform to underarm configuration of the sleeve to the body of the garment. What is not shown in the prior art is means for readily reducing the size of this garment shield to achieve a smaller desired size.

SUMMARY OF THE INVENTION

This invention may be summarized with reference to its objects.

It is an object of this invention to provide, and it does provide, a garment shield of substantially conventional construction and additionally provides means for removing an exterior portion of this shield so as to diminish the size thereof.

It is an object of this invention to provide, and it does provide, a garment shield in which arcuate or crescent shaped portions are provided with severing means to enable excess or unwanted portions of this garment shield to be removed.

It is a further object to provide, and it does provide, a foldable garment shield in which an adhesive strip or strips are provided on an exterior surface of the plastic moisture retaining barrier film. This garment shield is provided with an arcuate heat seal and perforating means interior of the initial exterior of the shield. This separating means is provided by a series of holes or elongated slots in the fiber and upper cover of the material. This separating means may extend through the film backing material or may be in the cover. If desired a reduced thickness for separating the film may be formed by using extra embossing means.

In brief, this garment shield may be summarized as being constructed in accordance with conventional practice but rather than only an exterior heat seal of the cover to the backing film there is provided an additional heat seal at an interior portion. At the outer extent of this additional heat seal there is provided either elongated slots or a series of round perforations providing means for ready removal and/or tearing of the garment shield to provide a reduced size arcuate garment shield. The impervious film back member may be provided with a weakening intermediate the perforations so that ready removal of the unwanted portion may be easily achieved.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a garment shield with reusable or removable exterior portions as adopted for use in clothing with attached sleeves and showing a preferred means for making said garment shield. This specific embodiment has been chosen for the purposes of illustration and description as shown in the accompanying drawings wherein:

BRIEF DESCRIPTION OF THE DRAWING

In the following description and in the claims various details are identified by specific names for convenience. These names are intended to be generic in their application. Corresponding reference characters refer to like members throughout the five figures of the drawings.

EMBODIMENT OF FIGS. 1, 2, 3 AND 4

Figure 2:
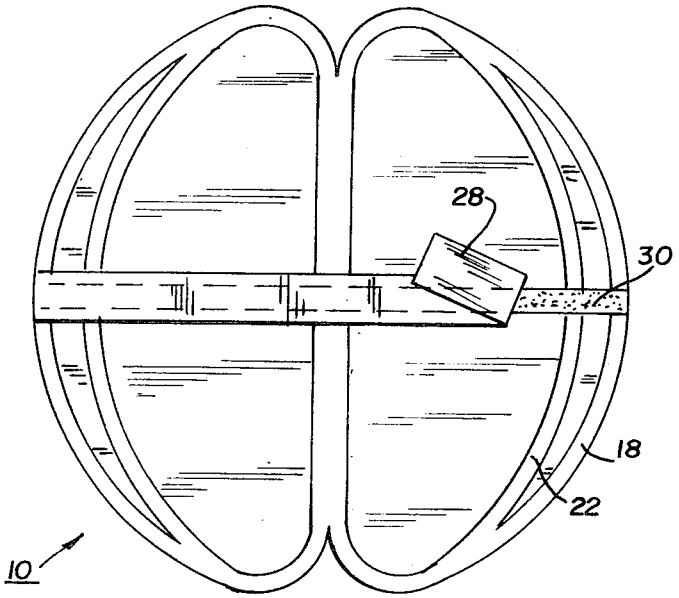
FIG. 2 represents a bottom view of the garment shield of this invention and showing the additional heat seal adhesive strip and a removable protective strip for use on the exterior of the garment shield.
Figure 1:
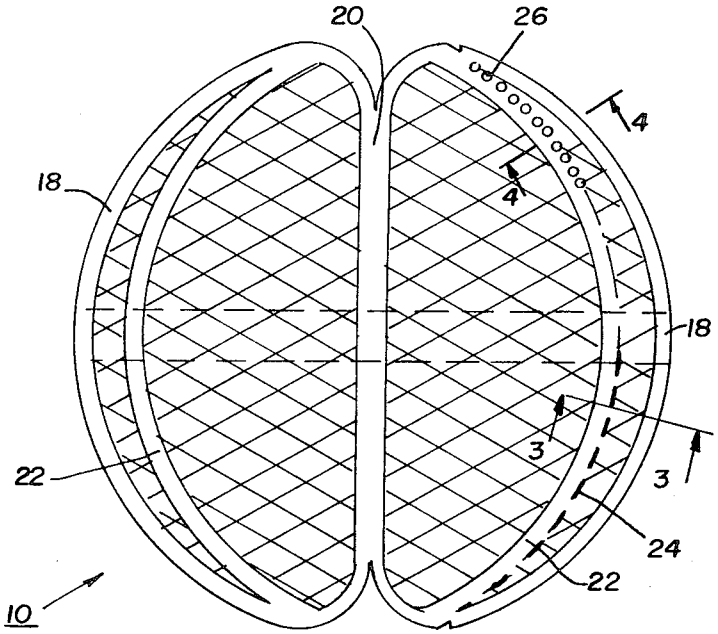
FIG. 1 represents a plan view of a garment shield showing the additional heat seal and perforating means for removal of the outer portion of the garment shield, this view showing two means of severing of the outer portion of the garment shield.

As seen in FIGS. 1, 2, 3 and 4, a garment shield is of conventional configuration and provides moisture inhibiting means. As seen in FIG. 1, this garment shield is generally identified as 10 with a top cover 12 and an intermediate fiber fill 14. This garment shield is made in a double crescent configuration and as shown has a bottom impervious and protective film 16 heat sealed on its exterior portions by a narrow seal 18. Interior seal 20 is shown and provides a securing of the cover to the bottom film 16 to provide a desired configuration. This interior heat seal 22 at its outer limit or outer edge is provided with perforations which may be elongated slots 24 or a series of small punched holes 26. Elongated slots 24 are shown in the lower right of FIG. 1 and perforations 26 are depicted in the upper right of FIG. 1 as a series of small holes or apertures and provides another means of easy separation of the cover material. The left side of FIG. 1 is absent this showing since either the elongated perforations 24 or the small apertures 26 may be used. It is also contemplated that slots and apertures as combinations may be provided. It is to be noted that this perforation and separation means is provided at the exterior of the inner heat seal 22 so that the edge provided by this heat seal 22 may be maintained after the unwanted exterior portion is removed and discarded. After removal, the remaining body of the garment shield is smaller. The lower film barrier 16 may be weakened by and reduced in thickness by heat sealing operations so as to assist in the ready removal of this exterior portion of the garment shield. Weakening of the film for ready removal or tearing is shown in U.S. Pat. No. 3,186,628 or other like patents and no patentable distinction is shown contemplated for this reduction in film thickness. Only one additional heat seal 22 is depicted in FIGS. 1 and 2 but this is not to be construed as a limitation since more than one removable portion may be provided.

Figure 4:
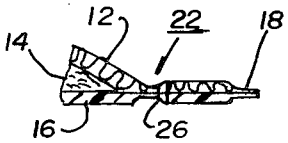
FIG. 4 represents a fragmentary sectional view of the garment shield of FIG. 1 and taken on the line 4—4 thereof and looking in the direction of the arrows.
Figure 3:
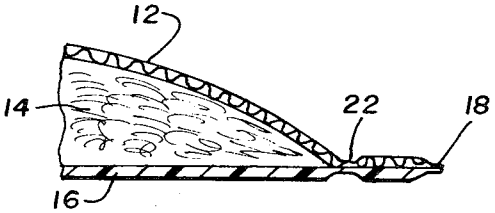
FIG. 3 represents, in a slightly enlarged scale, and partly fragmentary, a sectional view of an exterior of a garment shield, this view taken on the line 3—3 of FIG. 1 and looking in the direction of the arrows.

In FIG. 3 it is to be noted that the fragmentary sectional view is taken between rectangular perforations 24 and depicts the heat seal 22 as securing the cover 12 and bottom film 16. In FIG. 4 is shown the heat sealed area 22 with apertures 26 formed in both the cover 12 and bottom film 16. If desired, and as a matter of selection, apertures 26 may be provided in the upper cover 12 and bottom film member 16 before bringing the heat sealing in position.

SUMMARY OF OPERATION AS IN FIG. 5

Figure 5:
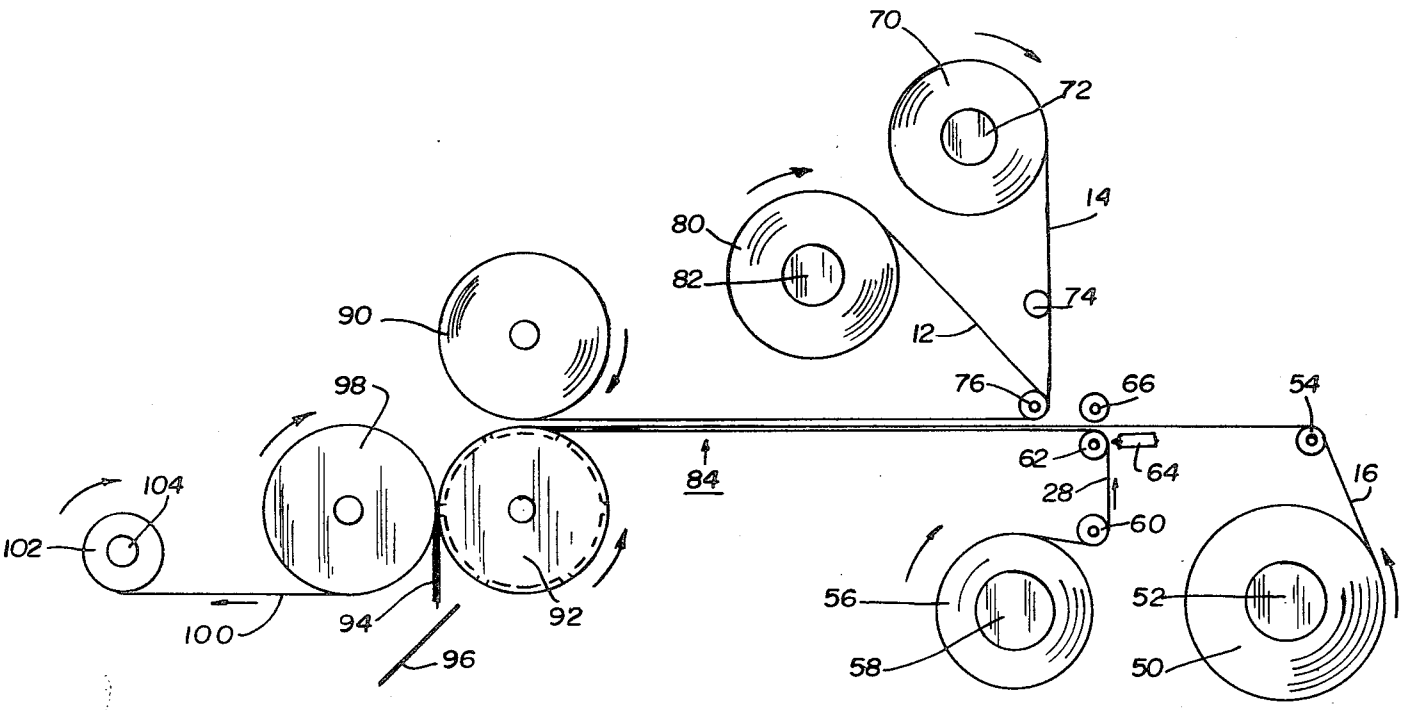
FIG. 5 represents a diagrammatic side view showing the suggested assembly mechanism for making this garment shield in a continuous production process.

In FIG. 5 is depicted a stick diagram of a potential sealing and assembling operation. Plastic bottom film 16 is shown in a roll form 50 on a support stand 52. An idler roller 54 carries this bottom film 16 to a horizontal attitude or run where it meets the tear strip or removable strip 28 carried in roll form 56 on a stand support 58. Idler rollers 60 and 62 carry this narrow removable strip to assembly. A glue gun 64 applies adhesive 30 to this narrow strip so that this adhesively coated strip may be mounted on the garment shield. Upper idler roller 66 is positioned so as to bring the plastic bottom film 16 and the strip 28 in the desired alignment and position. Fill 14 is shown in roll form and is adapted to be heat sealed. In roll form 70 this film is carried by a roll stand 72. After delivering from this roll 70 the fill 14 is directed to an idler roller 74 then to a redirecting idler roller 76. Cover material 12 is carried in a roll form 80 and delivered from a roll stand 82 in strip form also to redirecting idler roller 76.

As an assembly 84 this garment shield is fed in strip form to seal rollers 90 and 92. Roller 92 is depicted as having roller seal portions and eccentrically actuated cutting dies to provide the outer configurations and seals of the product. After the heat seals and perforations desired in the garment shield have been made, the shield is delivered as a finished product 94 to a chute or slide 96. Depicted is a cutter back-up roll 98 which mates with and operates in combination with the form seal and cutting die provided by roll 92. As shown by the arrows, a cutting back-up roll 98 moves in a clockwise rotation and the unwanted trim material is wound in strip form as a roll 102 carried by and on roll stand 104. It is to be noted that the heat seal is provided by heated roller 90 in engagement with and in combination with the rotating seal roller 92. Other means may be provided to perform this operation.

It is to be noted that this assembly diagram is shown as a suggested operation but other assembly apparatus may be provided if desired to accommodate the manufacturing procedures for production of this garment shield. In particular, it is to be noted that fiber fill 14, rather than in sheet form, may be provided as a bulk accumulation and dispensed onto a glued area on the upper surface of bottom film 16, and then cover 12 may be applied. A rotary seal and cutting die is shown but a reciprocating seal and cutting die with perforating means may be provided if desired.

It is to be noted that the garment shield of this invention provides a perforation and heat seal to provide a reduction of size. One or more of these crescent shaped seals and perforations may be provided so that tearing and removing of the unwanted portions may be accomplished without resorting to scissors and the like. It is to be noted that additional heat sealing of the cover to the back or the plastic backing is necessary so as to provide unwanted exposure of the edge of the shield fill between the cover and backing.

The garment shield as depicted is adapted to be easily folded and inserted into a garment to protect the armpit of the garment whether a dress, coat or the like. The impervious backing is usually film but may be treated material. It is desirable and essential that perforations with or without additional severing means be provided. This severing means should allow removal by the user without the need of a knife, scissors and the like and when the unwanted excess is removed and discarded the garment shield be secured at its edges to retain the remaining shield as a functional entity.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position in which the garment shield may be constructed or used.

While a particular embodiment of the garment shield and a suggested assembly method has been shown and described it is to be understood the invention is not limited thereto and protection is sought to the broadest extent the prior art allows.

What is claimed is:

1. A garment shield having a contoured outer periphery, this shield used for underarm protection and having a central portion which is thinner and sealed to provide a folding area at said central portion, this shield characterized as having a porous cover, filler portion and an impervious backing which has releasable adhesive means adapted to secure said shield within the garment, said shield also including:

(a) a peripherial heat seal of said cover to said backing;

(b) a heat seal at said central portion adapted to secure the cover to the backing and enabling folding to be easily achieved, and (c) at least one additional heat sealed portion disposed at a determined distance in from the initial outer peripherial edge of the shield and a line of perforations formed in and through at least the cover and positioned at the outward edge of said additional heat seal so as to maintain a heat sealed edge when that portion exterior of or outward from said perforations is removed so as to reduce the extent of the shield.

2. A garment shield as in claim 1, in which the impervious backing is a thin film and at the perforation line there is a thinning of the backing film to allow separation along said line.

3. A garment shield as in claim 2 in which the backing film is additionally perforated as and when the cover is perforated.

4. A garment shield as in claim 1 in which the line of perforations include perforations that extend through said cover and backing.

5. A garment shield as in claim 1 in which the releasable adhesive means on the outside of the backing is a single stripe and is covered by a release strip.

6. A garment shield as in claim 1 in which the fill is material in sheet form and is dispensed from a roll supply.

7. A garment shield as in claim 1 in which the fill is material in a loose form and is secured to the backing by adhesive means to provide localized areas of fill.

8. A garment shield as in claim 1 in which the perforations are slot-like in configuration.

9. A garment shield as in claim 1 in which the perforations are small apertures.

10. A garment shield as in claim 1 in which the perforations are a combination of slots and small apertures.

* * * * *